US011359589B2

(12) United States Patent
Ucal et al.

(10) Patent No.: US 11,359,589 B2
(45) Date of Patent: Jun. 14, 2022

(54) VALVE FOR METERING A FLUID

(71) Applicant: Robert Bosch GmbH, Stuttgart (DE)

(72) Inventors: Murat Ucal, Stuttgart (DE); Andreas Glaser, Stuttgart (DE); Axel Heinstein, Wimsheim (DE); Christian Suenkel, Altenkunstadt (DE); Frank Mueller, Ebensfeld (DE); Joerg Abel, Gerlingen (DE); Marcel Behringer, Baunach (DE); Martin Buehner, Backnang (DE); Matthias Boee, Ludwigsburg (DE); Norbert Redlich, Hirschaid (DE); Peter Schramm, Knetzgau (DE); Stefan Cerny, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 314 days.

(21) Appl. No.: 16/470,831

(22) PCT Filed: Oct. 19, 2017

(86) PCT No.: PCT/EP2017/076701
§ 371 (c)(1),
(2) Date: Jun. 18, 2019

(87) PCT Pub. No.: WO2018/114088
PCT Pub. Date: Jun. 28, 2018

(65) Prior Publication Data

US 2019/0309712 A1 Oct. 10, 2019

(30) Foreign Application Priority Data

Dec. 21, 2016 (DE) ..... 102016225776.5

(51) Int. Cl.
*F02M 51/06* (2006.01)
*F02M 61/12* (2006.01)
*F02M 61/20* (2006.01)

(52) U.S. Cl.
CPC .... *F02M 51/0671* (2013.01); *F02M 51/0685* (2013.01); *F02M 61/12* (2013.01); *F02M 61/205* (2013.01)

(58) Field of Classification Search
CPC ..... F02M 51/0671; F02M 51/0685; F02M 61/12; F02M 61/205; F02M 55/008; F02M 63/0075; F02M 51/066; F02M 63/0022
(Continued)

(56) References Cited

U.S. PATENT DOCUMENTS 3,707,992 A * 1/1973 Ellison ..... F16K 31/0627 137/625.65
5,984,210 A * 11/1999 Forck ..... F02M 63/0031 239/585.1
(Continued)

FOREIGN PATENT DOCUMENTS

CN 1464941 A 12/2003
CN 1533474 A 9/2004
(Continued)

OTHER PUBLICATIONS

International Search Report for PCT/EP2017/076701, dated Jan. 22, 2018.

*Primary Examiner* — Phutthiwat Wongwian
*Assistant Examiner* — Arnold Castro
(74) *Attorney, Agent, or Firm* — Norton Rose Fulbright US LLP; Gerard Messina

(57) ABSTRACT

A valve for metering a fluid is described, which is used, in particular, as a fuel injector for internal combustion engines,
(Continued)

including an electromagnetic actuator and a valve needle actuatable by the actuator, an armature of the actuator being guided on valve needle, a stop element which limits a movement of the armature relative to the valve needle being situated on the valve needle, and the armature including a spring receptacle which is open toward the stop element and in which a spring supported on the stop element is inserted. The valve needle is guided via the armature and/or the stop element along a longitudinal axis of a housing. Furthermore, as viewed along the longitudinal axis, a length of the spring receptacle is smaller than a spring length of the spring in the non-actuated initial state.

16 Claims, 4 Drawing Sheets

(58) Field of Classification Search
USPC ..... 239/585.2, 585.3
See application file for complete search history.

(56) References Cited

U.S. PATENT DOCUMENTS

| | | | | |
|---|---|---|---|---|
| 6,808,133 | B1 * | 10/2004 | Stier | F02M 61/166 239/585.1 |
| 9,383,028 | B2 * | 7/2016 | Bleeck | F02M 63/0015 |
| 2012/0067982 | A1 | 3/2012 | Perry et al. | |
| 2019/0219014 | A1 * | 7/2019 | Schaad | B05B 1/302 |

FOREIGN PATENT DOCUMENTS

| | | | |
|---|---|---|---|
| CN | 105508109 | A | 4/2016 |
| DE | 102013222613 | A1 | 5/2015 |
| EP | 2789844 | A1 | 10/2014 |
| JP | 2002357173 | A | 12/2002 |
| JP | 2010180758 | A | 8/2010 |
| JP | 2011208603 | A | 10/2011 |
| WO | 0125614 | A1 | 4/2001 |
| WO | 2015049195 | A1 | 4/2015 |

* cited by examiner

VALVE FOR METERING A FLUID

FIELD OF THE INVENTION

The present invention relates to a valve for metering a fluid, in particular to a fuel injector for internal combustion engines. Specifically, the present invention relates to the field of injectors for fuel injection systems of motor vehicles, in which preferably a direct injection of fuel into combustion chambers of an internal combustion engine takes place.

BACKGROUND INFORMATION

A valve for metering fluid is known from German Published Patent Application No. 10 2013 222 613. The known valve includes a solenoid for actuating a valve needle controlling a metering opening. The solenoid is used to actuate an armature movable on a valve needle. The armature has a borehole which abuts the valve needle and forms a spring receptacle for a prestroke spring.

This design has the disadvantage that a guidance between the armature and the valve needle is only implemented over a short guide length.

SUMMARY

The valve according to the present invention has the advantage that an improved design and functionality are enabled. In particular, an improved guidance between the armature and the valve needle and of the valve needle along a longitudinal axis of the housing may be implemented.

On the valve for metering the fluid, the armature serving as a solenoid armature is not fixedly connected to the valve needle, but is overhung between stops. Such a stop may be formed on a stop element, which may be implemented as a stop sleeve and/or stop ring. The stop element, however, may also be designed in one piece with the valve needle. With the aid of a spring, the armature, in the resting state, is adjusted to a stop which is stationary with respect to the valve needle, so that the armature rests against it. When the valve is activated, the entire armature free travel is then available as an acceleration distance, the spring being shortened during the acceleration. The armature free travel may be predefined via the axial play between the armature and the two stops.

The present invention has the advantage that the guide length between the armature and the valve needle is increased. For example, the armature may be guided on its outer side in the valve housing along the longitudinal axis. Accordingly, the guidance of the valve needle along the longitudinal axis then improves over the increased guide length between the armature and the valve needle. One embodiment in which the valve needle is guided via the stop element, for example, on an inner pole situated in the housing in a stationary manner accordingly results in an improved guidance of the armature relative to the housing.

The present invention has the advantage that an additional extension of the guide length may be achieved, which is independent of the design of the spring receptacle. In this way, it is possible, for example, for the spring receptacle to directly abut the valve needle. In this way, in particular, a robust design is possible in which the guide extension is able to absorb stop forces.

The present invention has the advantage that the guide extension, in particular, may be designed with an outside diameter which is situated within openings of through-openings of the armature used to conduct a fluid through the armature. This has a favorable effect on the operating behavior.

The present invention has the advantage that a guidance may be achieved which is as good as or even better than in the case of an armature without spring receptacle.

The present invention has the advantage that the spring, during actuation, is able to immerge completely into the spring receptacle, so that an optimal compromise with respect to multiple disadvantages of a conventional design may be achieved.

The disadvantages of a conventional design first relate to the manufacturability, the costs and the assembly when a design without spring receptacle is implemented in which an additional component for accommodating the spring and its connection to the armature is required. Secondly, disadvantages result when a pole surface between the armature and the inner pole is reduced since then a lower magnetic force occurs. This relates specifically to one possible embodiment in which a stepped borehole is formed on the inner pole to create space for a spring.

A third disadvantage relates to a magnetic short circuit via the spring and the loss of magnetic force associated therewith, which results in a slower force build-up and a lower holding force in the opened state. In general, this relates to the used magnetic spring steels, which represent a bypass for the magnetic flux between the armature and the inner pole. A fourth disadvantage relates to the smaller contact surface between the armature and a stop ring in one variant, in which the stop ring immerges into the spring receptacle formed on the armature. This may cause increased wear and reduced hydraulic damping.

In a fifth disadvantage, a lever arm may result between the upper needle guide and the armature, which relates, in particular, to the above-mentioned embodiment in which the stop ring immerges into the spring receptacle. This may result in large bending of the needle, which leads to increased wear, an oblique impact and the like. A sixth possible disadvantage relates to embodiments in which a large spring diameter becomes necessary. Due to the limited radial installation space, lower spring forces are then achievable, which is bad for fast armature settling after the first injection, in particular with respect to multiple injections. At the same spring force, a larger spring diameter moreover means a larger tilting moment onto the armature, which is also disadvantageous for the injector function and, in particular, may result in a tilted armature impact. A seventh and last disadvantage relates to the risk of the spring bulging under load and to the resultant contact with the inner pole and/or the stop ring due to a relatively long spring length and small radial spatial conditions. This causes an undefined friction which, in addition to possible wear and the development of particles, results in considerable variances of the injection behavior.

In this way, as a result of the complete immergence of the spring into the spring receptacle of the armature, an optimal compromise with respect to the above-described possible disadvantages may be achieved. The stop element may be manufactured from a non-magnetic material, whereby it is able to separate the inner pole from the armature from a magnetic point of view. Furthermore, the lever arm may be kept short. Both a pole surface and a stop surface between the armature and the stop element, in particular stop ring, may be selected to be sufficiently large. Furthermore, a relatively small inside diameter of the spring may be implemented, so that it is possible to achieve relatively high spring forces, even with a comparatively thin wire gauge of the spring. Moreover, the spring may also have a relatively short design, so that the risk of bulging and accordingly occurring wear is reduced, and a tilting moment introduced onto the armature in this regard remains within acceptable limits.

The present invention enables an advantageous flow through the armature. In this way, a guidance of the armature in the housing may be achieved in one possible embodiment. Furthermore, in one further possible embodiment, an annular gap between the armature and the housing may be minimized. With respect to predefined housing dimensions, this results in a faster force build-up and a great holding force. Due to the combination of the through-openings with the spring receptacle, moreover the end face of the armature facing the inner pole can be designed to be larger than when separate through-openings are implemented.

The present invention has the further advantage that the flow cross section may be increased disproportionately in relation to the resultant reduction of the surface area of the end face of the armature.

The present invention has the advantage that an advantageous fuel flow may be achieved in the area of the stop element, without having to increase the internal borehole of the inner pole.

DETAILED DESCRIPTION

Figure 1:
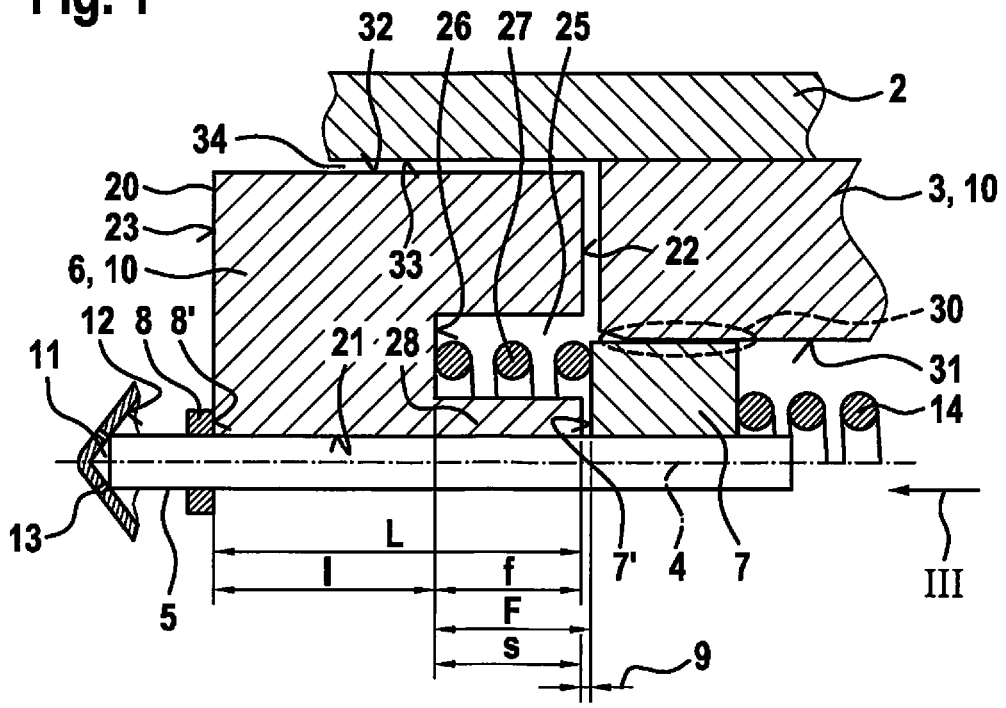
FIG. 1 shows a valve in an excerpted, schematic sectional illustration corresponding to a first exemplary embodiment.

FIG. 1 shows a valve 1 for metering a fluid in an excerpted, schematic sectional illustration corresponding to a first exemplary embodiment. Valve 1 may, in particular, be designed as a fuel injector 1. A preferred application is a fuel injection system in which such fuel injectors 1 are designed as high pressure injectors 1 and used to inject fuel directly into assigned combustion chambers of the internal combustion engine. For this purpose, liquid or gaseous fuels may be used as the fuel. Accordingly, valve 1 is suitable for metering liquid or gaseous fluids.

Valve 1 includes a housing (valve housing) 2 in which an inner pole 3 is situated in a stationary manner. A longitudinal axis 4, which serves as a reference for the guidance of a valve needle 5 situated inside housing 2 here, is determined by housing 2. This means that, during operation, an orientation of valve needle 5 along longitudinal axis 4 is to take place.

An armature (solenoid armature) 6 is situated on valve needle 5. Moreover, a stop element 7 and a further stop element 8 are situated on valve needle 5. Stops 7',8' are formed on stop elements 7, 8. Armature 6 may be moved between stop elements 7, 8 during an actuation, an armature free travel 9 being predefined. Armature 6, inner pole 3 and a solenoid coil, which is not shown, are integral parts of an electromagnetic actuator 10.

A valve closing body 11, which cooperates with a valve seat surface 12 to form a seal seat, is formed on valve needle 5. During an actuation of armature 6, it is accelerated in the direction toward inner pole 3. When armature 6 strikes against stop 7' of stop element 7 and thereby actuates valve needle 5, fuel may be injected via the opened seal set and at least one nozzle opening 13 into a chamber, in particular a combustion chamber.

Valve 1 includes a return spring 14, which adjusts valve needle 5 via stop element 7 into its initial position in which the seal seat is closed.

Armature 6 is based on a cylindrical basic shape 20 including a through-borehole 21, armature 6 being guided on valve needle 5 at through-borehole 21. Basic shape 20 of armature 6 has a length L between an end face 22 facing inner pole 3 and an end face 23 facing away from inner pole 3.

Armature 6 includes a spring receptacle 25. Spring receptacle 25 is open on end face 22 of armature 6. Along longitudinal axis 4, spring receptacle 25 has a length f between end face 22 and a spring support surface 26 of armature 6. Spring support surface 26 represents bottom 26 of spring receptacle 25. In the initial state, in which the seal seat is closed, a spring 27 situated partially in spring receptacle 25 has a spring length F. Spring length F is spring length F of spring 27 in the non-actuated initial state here. Spring 27 is supported on spring support surface 26 of armature 6 on the one hand, and on stop 7' of stop element 7 on the other hand. Spring length F is greater than length f of spring receptacle 25. During an actuation of armature 6, however, spring 27 is shortened compared to its initial length F, it being able to immerge completely into spring receptacle 25.

A guide web 28 is formed on armature 6 in this exemplary embodiment. Between spring support surface 26 and end face 23, armature 6 has a (shortened) length l along longitudinal axis 4. Without guide web 28, only this shortened length l would be available as the guide length. As a result of guide web 28, length l is extended by length s of guide web 28 along longitudinal axis 4. This results in guide length l+s in this exemplary embodiment. Length s of guide web 28 is preferably selected to be as large as or even greater than length f of spring receptacle 25. Guide length l+s of armature 6 on valve needle 5 is thus equal to or even greater than length L of armature 6 between its end faces 22, 23.

The guidance of valve needle 5 with respect to longitudinal axis 4 or with respect to housing 2 in this exemplary embodiment is derived with the aid of stop element 7. Stop element 7 is guided in a guidance area 30 on an internal borehole 31 of inner pole 3. Possible embodiments of stop element 7 which enable an advantageous through-conduction of the fluid, in particular fuel, are described based on FIGS. 5 through 8. In this exemplary embodiment, an annular gap 34 results between an outer side 32 of armature 6 and an inner side 33 of housing 2.

In one modified embodiment, the guidance of valve needle 5 may, in addition or as an alternative, also be implemented via armature 6. Outer side 32 of armature 6 extends at least partially to inner side 33 of housing 2. Instead of guidance area 30, in this embodiment an annular gap may then be implemented between stop element 7 and inner pole 3.

In this way, an advantageous guidance of valve needle 5 along longitudinal axis 4 may be implemented. At the same time, this results in an advantageous guidance between armature 6 and valve needle 5 over a guide length l+s, which preferably is not smaller than length L.

Figure 2:
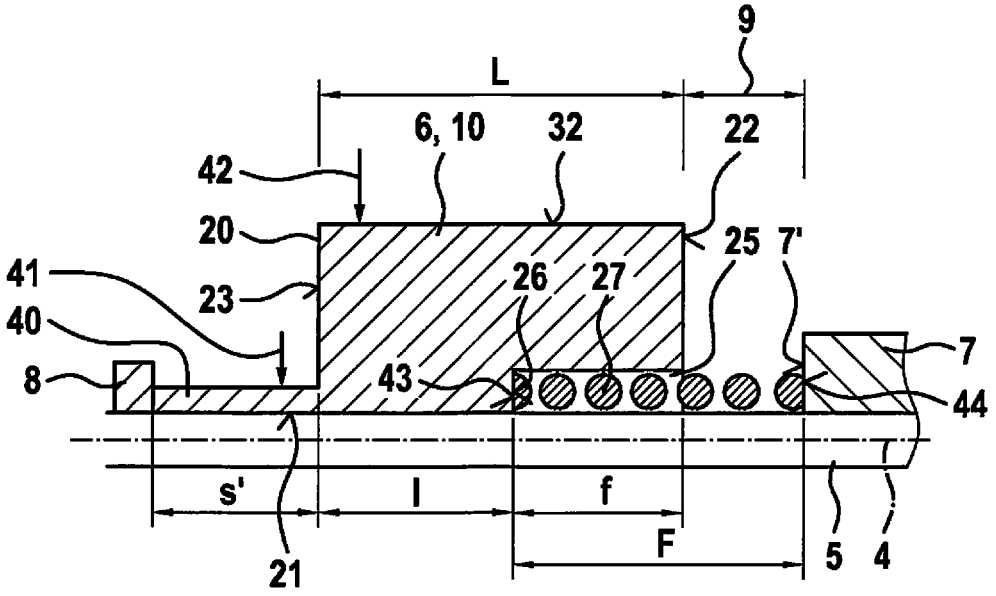
FIG. 2 shows a valve in an excerpted, schematic sectional illustration corresponding to a second exemplary embodiment.

FIG. 2 shows a valve 1 in an excerpted, schematic sectional illustration corresponding to a second exemplary embodiment. In this exemplary embodiment, a guide extension 40 is provided. Guide extension 40 has a length s' along longitudinal axis 4 which extends the guidance of armature 6 on valve needle 5. This means that, in this exemplary embodiment, guide length s'+l is implemented along longitudinal axis 4 between armature 6 and valve needle 5.

It is thus possible, in this exemplary embodiment, for spring receptacle 25 to directly abut valve needle 5. This facilitates, in particular the manufacture of armature 6 since spring receptacle 25 may be implemented by a cylindrical recess oriented on longitudinal axis 4. However as a result, only length l, which is shortened compared to length L of armature 6 which the armature has between end faces 22, 23, is available directly on basic shape 20 of armature 6. This shortened length l is thus extended to a certain extent by length s' via guide extension 40. Specifically, length s' may be predefined in such a way that guide length s'+l is as large as or even greater than length L of armature 6 between its end faces 22, 23.

Moreover, guide extension 40 has a sleeve-shaped design. This means that an outside diameter 41 on guide extension 40 is selected to be considerably smaller than an outside diameter 42 on outer side 32 of armature 6.

Furthermore, spring 27 is designed with ground spring ends 43, 44 in this exemplary embodiment. This results in an even better support. Furthermore, it results in reduced wear and a more uniform force introduction into armature 6 on spring support surface 26 on the one hand, and on stop 7' of stop element 7 on the other hand.

Figure 3:
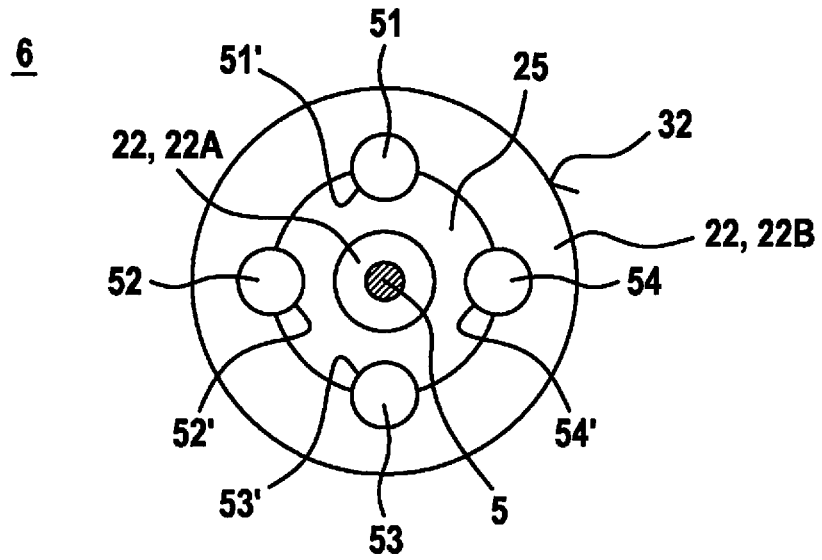
FIGS. 3 and 4 show possible embodiments of an armature of a valve from the viewing direction denoted by III in FIG. 1.
Figure 4:
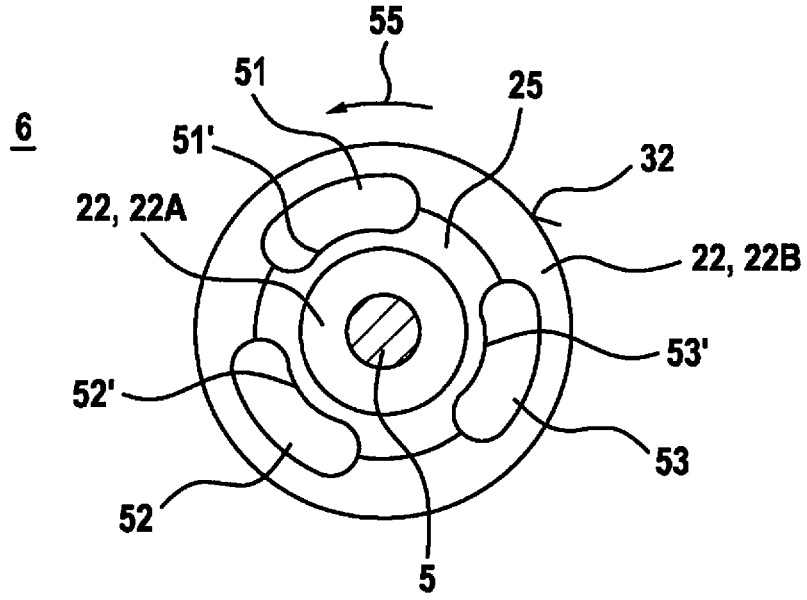

FIGS. 3 and 4 show possible embodiments of armature 6 of valve 1 from the viewing direction denoted by III in FIG. 1, valve needle 5 being shown as a cut surface for improved comprehensibility. End face 22 is divided into sub-surfaces 22A and 22B between which spring receptacle 25 is provided. Furthermore, through-openings 51 through 54 are provided, which in this exemplary embodiment are designed as through-boreholes 51 through 54 having a circular cross section. This results in combinations between through-boreholes 51 through 54 and spring receptacle 25. This means that the fuel is able to flow over length f of spring receptacle both through the portion of spring receptacle 25 not taken up by spring 27 and through through-openings 51 through 54. Thereafter, the fuel then flows only through through-openings 51 through 54 over shortened length l. In this way, a flow of fuel from end face 22 to end face 23 with little restriction is made possible, without the overall surface area of end face 22, which is made up of sub-surfaces 22A, 22B, being further reduced. This favorably affects the activation behavior during an actuation of armature 6 since this results in both a great magnetic force and reduced hydraulic restriction.

In the exemplary embodiment described based on FIG. 4, additionally kidney-shaped configurations of through-openings 51 through 54 are implemented, so that through-openings 51 through 54 extend in a circumferential direction 55 about longitudinal axis 4 or circumferentially about longitudinal axis 4 over a larger angular range. In this way, in particular the fuel flow over shortened length l of armature 6 is improved.

FIGS. 5 through 8 show possible embodiments of stop element 7 of valve 1 counter to the viewing direction denoted by III in FIG. 1, valve needle 5 being shown in a sectional view for illustration purposes. A support area 60 is predefined for spring 27. Support area 60 is radially outwardly delimited by a broken line 60A. Furthermore, support area 60 is radially inwardly delimited by a broken line 601. Support area 60 serves as support area 60 predefined by the design in which the selected spring 27 is to be supported. Furthermore, the embodiments preferably relate to an application in which a guidance between stop element 7 and inner pole 3 is implemented, as is illustrated in FIG. 1, for example.

To conduct the fuel past stop element 7, recesses 61 through 64 are provided. Proceeding from a hollow cylindrical basic shape 65, which is characterized by an outside diameter D, stop element 7 may be modified by such recesses 61 through 64. This results in both the option of a guidance on the outside diameter D and a fuel conduction through recesses 61 through 64.

Recesses 61 through 64 are designed in such a way here that, as viewed from longitudinal axis 4, they extend maximally up to a diameter d. This means that a circular ring-shaped surface area 66 remains from valve needle 5 up to diameter d.

Preferably, diameter d is predefined in such a way that it is between outer line 60A and inner line 601. As a result, spring 27 at least partially rests against support area 60, namely at least against circular ring-shaped surface area 66, even in the area of recesses 61 through 64. This results in a compromise between a good contact of spring 27 on support area 60 and preferably large recesses 61 through 64 and, simultaneously, in the option of a guidance on outside diameter D.

Figure 5:
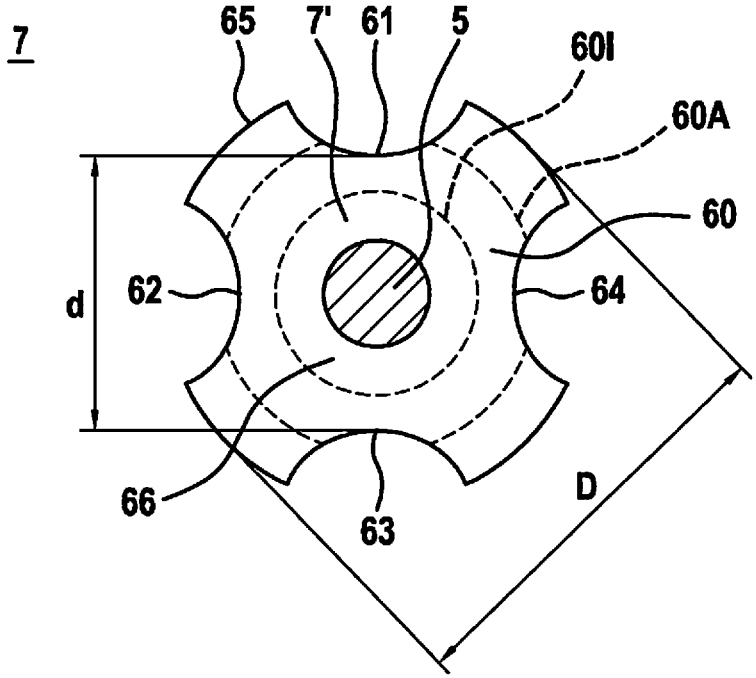
FIGS. 5 through 8 show possible embodiments of a stop element of a valve counter to the viewing direction denoted by III in FIG. 1.
Figure 6:
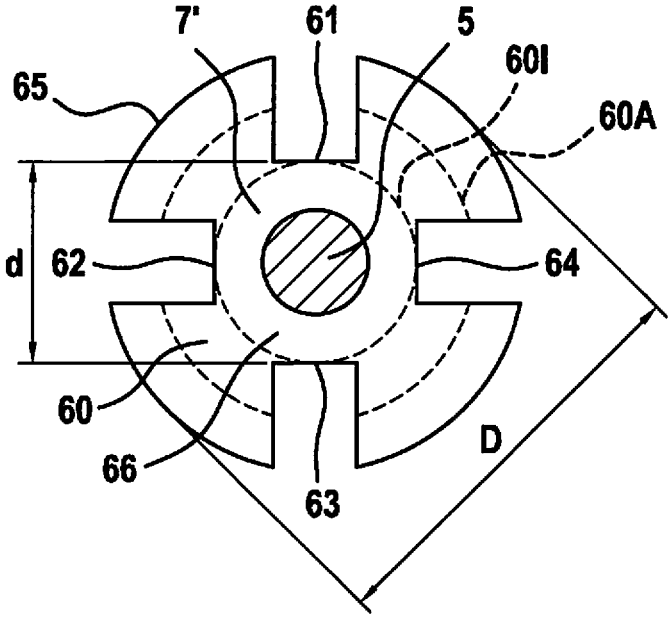
Figure 7:
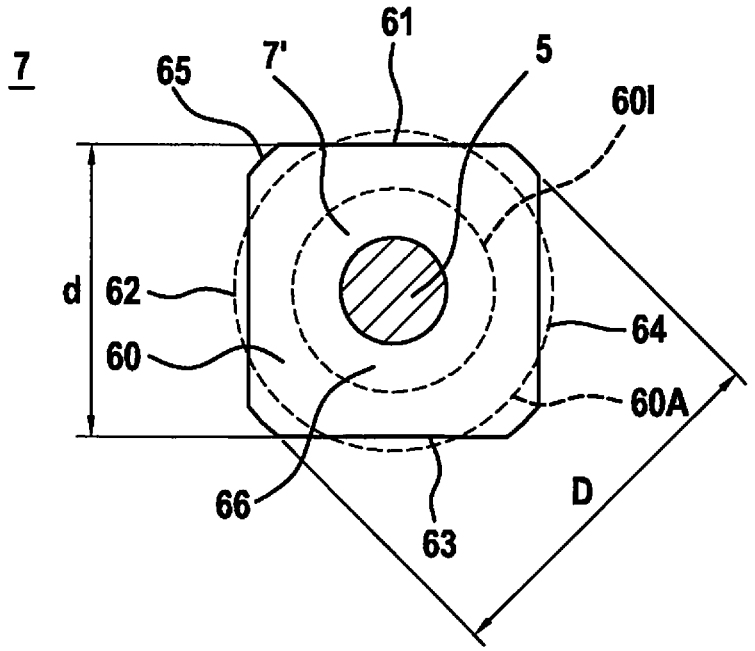
Figure 8:
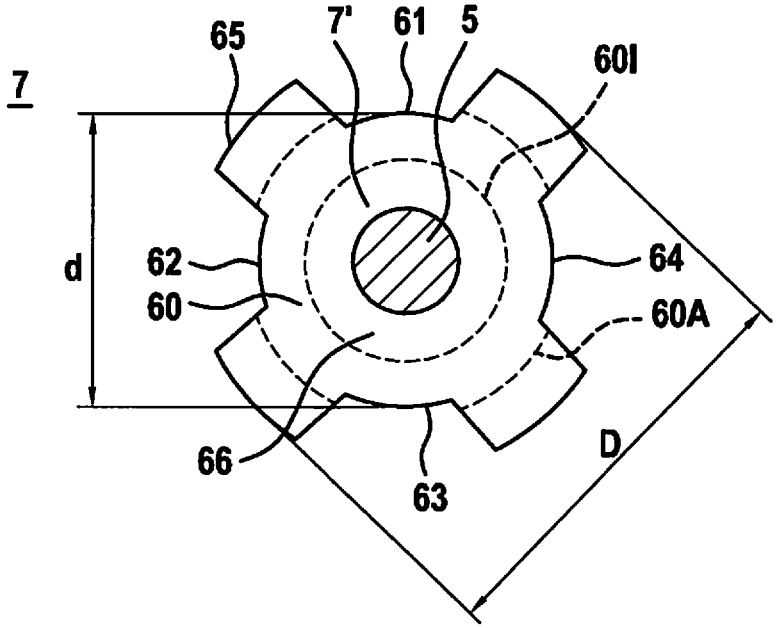

FIGS. 5 through 8 show different options for designing recesses 61 through 64. In FIG. 5 as a combination with cylinder boreholes, in FIG. 6 as combinations with rectangular milled-out portions, and in FIG. 7 as a combination with flat portions. In the embodiment according to FIG. 8, the flow cross section may be formed by annular segments.

The present invention is not limited to the described exemplary embodiments.

What is claimed is:

1. A valve for metering a fluid, comprising:

a housing;

an electromagnetic actuator;

a valve needle actuatable by the actuator, wherein an armature of the actuator is guided on the valve needle;

a stop element that limits a movement of the armature relative to the valve needle, wherein the stop element is situated on the valve needle;

a spring supported on the stop element, wherein the armature includes a spring receptacle that is open toward the stop element and in which the spring supported on the stop element is inserted, wherein the valve needle is guided via at least one of the armature and the stop element along a longitudinal axis of the housing, and wherein as viewed along the longitudinal axis, a length of the spring receptacle is smaller than a spring length of the spring in a non-actuated initial state; and a guide extension that faces away from the stop element and guides the armature along the longitudinal axis on the valve needle, wherein the guide extension is provided on the armature.

2. The valve as recited in claim 1, wherein the valve is a fuel injector for an internal combustion engine.

3. The valve as recited in claim 1, wherein at least one of:

a guide web faces the stop element and guides the armature along the longitudinal axis on the valve needle is formed on the armature, and the spring receptacle is formed by an annular groove not abutting the valve needle.

4. The valve as recited in claim 1, wherein one of the guide extension is formed on the armature, and the guide extension is integrally joined to the armature.

5. The valve as recited in claim 1, wherein the guide extension is a sleeve-shaped guide extension.

6. The valve as recited in claim 1, wherein the spring, during actuation, is shortenable to the length of the spring receptacle which is predefined by the spring receptacle of the armature.

7. The valve as recited in claim 1, wherein the armature includes at least one through-opening that extends along the longitudinal axis and is combined with the spring receptacle.

8. The valve as recited in claim 1, wherein the stop element has a hollow cylindrical basic shape having an outside diameter with respect to the longitudinal axis and, on an outer side of the basic shape, at least one recess is formed up to a second diameter with respect to the longitudinal axis, and wherein a support area for the spring is situated within the outside diameter of the stop element and outside the second diameter of the stop element.

9. The valve of claim 1, wherein the guide extension has a sleeve-shaped configuration, so that an outside diameter on the guide extension is smaller than an outside diameter on an outer side of the armature.

10. The valve of claim 9, wherein the spring includes ground spring ends, which results in reduced wear and a more uniform force introduction into the armature on the spring support surface and on the stop of the stop element.

11. A valve for metering a fluid, comprising:

a housing;

an electromagnetic actuator;

a valve needle actuatable by the actuator, wherein an armature of the actuator is guided on the valve needle;

a stop element that limits a movement of the armature relative to the valve needle, wherein the stop element is situated on the valve needle;

a spring supported on the stop element, wherein the armature includes a spring receptacle that is open toward the stop element and in which the spring supported on the stop element is inserted, wherein the valve needle is guided via at least one of the armature and the stop element along a longitudinal axis of the housing, and wherein as viewed along the longitudinal axis, a length of the spring receptacle is smaller than a spring length of the spring in a non-actuated initial state; and wherein, as viewed along the longitudinal axis, at least one of: a guide length over which the armature is guided on the valve needle is not smaller than an armature length, and the guide length over which the armature is guided on the valve needle is made up of a length of the armature that is shortened by the length of the spring receptacle, plus at least one of a length of a guide web and a length of a guide extension.

12. A valve for metering a fluid, comprising:

a housing;

an electromagnetic actuator;

a valve needle actuatable by the actuator, wherein an armature of the actuator is guided on the valve needle;

a stop element that limits a movement of the armature relative to the valve needle, wherein the stop element is situated on the valve needle;

a spring supported on the stop element, wherein the armature includes a spring receptacle that is open toward the stop element and in which the spring supported on the stop element is inserted, wherein the valve needle is guided via at least one of the armature and the stop element along a longitudinal axis of the housing, and wherein as viewed along the longitudinal axis, a length of the spring receptacle is smaller than a spring length of the spring in a non-actuated initial state;

wherein the armature includes at least one through-opening that extends along the longitudinal axis and is combined with the spring receptacle, and wherein the at least one through-opening has an expanded kidney-shape in a circumferential direction.

13. A valve for metering a fluid, comprising:

a housing;

an electromagnetic actuator;

a valve needle actuatable by the actuator, wherein an armature of the actuator is guided on the valve needle;

a stop element that limits a movement of the armature relative to the valve needle, wherein the stop element is situated on the valve needle;

a spring supported on the stop element, wherein the armature includes a spring receptacle that is open toward the stop element and in which the spring supported on the stop element is inserted, wherein the valve needle is guided via at least one of the armature and the stop element along a longitudinal axis of the housing, and wherein as viewed along the longitudinal axis, a length of the spring receptacle is smaller than a spring length of the spring in a non-actuated initial state; and a guide extension that guides the armature along the longitudinal axis on the valve needle, wherein the guide extension is provided on the armature;

wherein the spring receptacle directly abuts the valve needle, and wherein the spring receptacle is implemented by a cylindrical recess oriented on the longitudinal axis.

14. The valve of claim 13, wherein the spring receptacle has a length 1, which is shorter than a length L of the armature between end faces of the armature, wherein the length 1 is extended by a length s' via the guide extension, and wherein the length s' is predefined so that a guide length s'+1 is at least as large as the length L of the armature between the end faces of the armature.

15. The valve of claim 13, wherein the guide extension has a sleeve-shaped configuration, so that an outside diameter on the guide extension is smaller than an outside diameter on an outer side of the armature.

16. The valve of claim 15, wherein the spring includes ground spring ends, which results in reduced wear and a more uniform force introduction into the armature on the spring support surface and on the stop of the stop element.

* * * * *